United States Patent [19]

Siegfried

[11] Patent Number: 5,038,834

[45] Date of Patent: Aug. 13, 1991

[54] ENCASING TUBING HAVING CONTINUOUS BONDING ENHANCING PROPERTIES

[75] Inventor: Erwin Siegfried, Liebefeld, Switzerland

[73] Assignee: VSL International AG, Bern, Switzerland

[21] Appl. No.: 320,318

[22] Filed: Mar. 7, 1989

[30] Foreign Application Priority Data

Mar. 8, 1988 [CH] Switzerland ..... 861/88

[51] Int. Cl.[5] ..... F16L 11/12

[52] U.S. Cl. ..... 138/173; 138/103; 138/108; 138/110; 138/122; 138/177; 74/502.5

[58] Field of Search ..... 138/108, 103, 110, 113, 138/121, 122, 173, 172, 177, 178, DIG. 11, 39; 74/502.5

[56] References Cited

U.S. PATENT DOCUMENTS

| | | | |
|---|---|---|---|
| 290,659 | 12/1883 | Austin | 138/173 |
| 485,783 | 11/1892 | Berger | 138/173 |
| 498,458 | 5/1893 | Callan | 138/173 |
| 862,919 | 8/1907 | Issacs et al. | 138/39 |
| 1,827,437 | 10/1931 | Pascoe | 138/173 |
| 1,913,390 | 6/1933 | Hungerford | 74/502.5 |
| 2,819,488 | 1/1958 | Gimbel | 138/122 |
| 2,968,321 | 1/1961 | Kahn | 138/122 |
| 3,345,590 | 10/1967 | Wolfgang et al. | 138/122 |
| 3,902,552 | 9/1975 | McLain | 138/173 |
| 4,112,708 | 9/1978 | Fukuda | 74/502.5 |
| 4,562,733 | 1/1986 | Kant | 138/122 |
| 4,802,511 | 2/1989 | Hensley | 138/122 |

FOREIGN PATENT DOCUMENTS

| | | | |
|---|---|---|---|
| 1291093 | 3/1969 | Fed. Rep. of Germany . | |
| 1659181 | 12/1970 | Fed. Rep. of Germany . | |
| 1038443 | 9/1953 | France | 138/122 |
| 2024 | of 1888 | United Kingdom | 138/173 |

*Primary Examiner*—James E. Bryant, III

*Attorney, Agent, or Firm*—Oldham & Oldham Co.

[57] ABSTRACT

The wall (5) of the encasing tube (1) includes spiralling protrusions (3, 4). First protrusions (3) and second protrusions (4) run either in different directions or in the same direction but at different pitches. The encasing tube is used for enclosing tensioning cable (2) in concrete structures. By means of the particular arrangement of the protrusions, the flow properties of the grout are improved, air bubbles are virtually eliminated during injection, and the bonding properties of tensioning cables are improved by means of large bonding zones while respecting the required high fatigue strength.

10 Claims, 4 Drawing Sheets

ENCASING TUBING HAVING CONTINUOUS BONDING ENHANCING PROPERTIES

Figure 1:
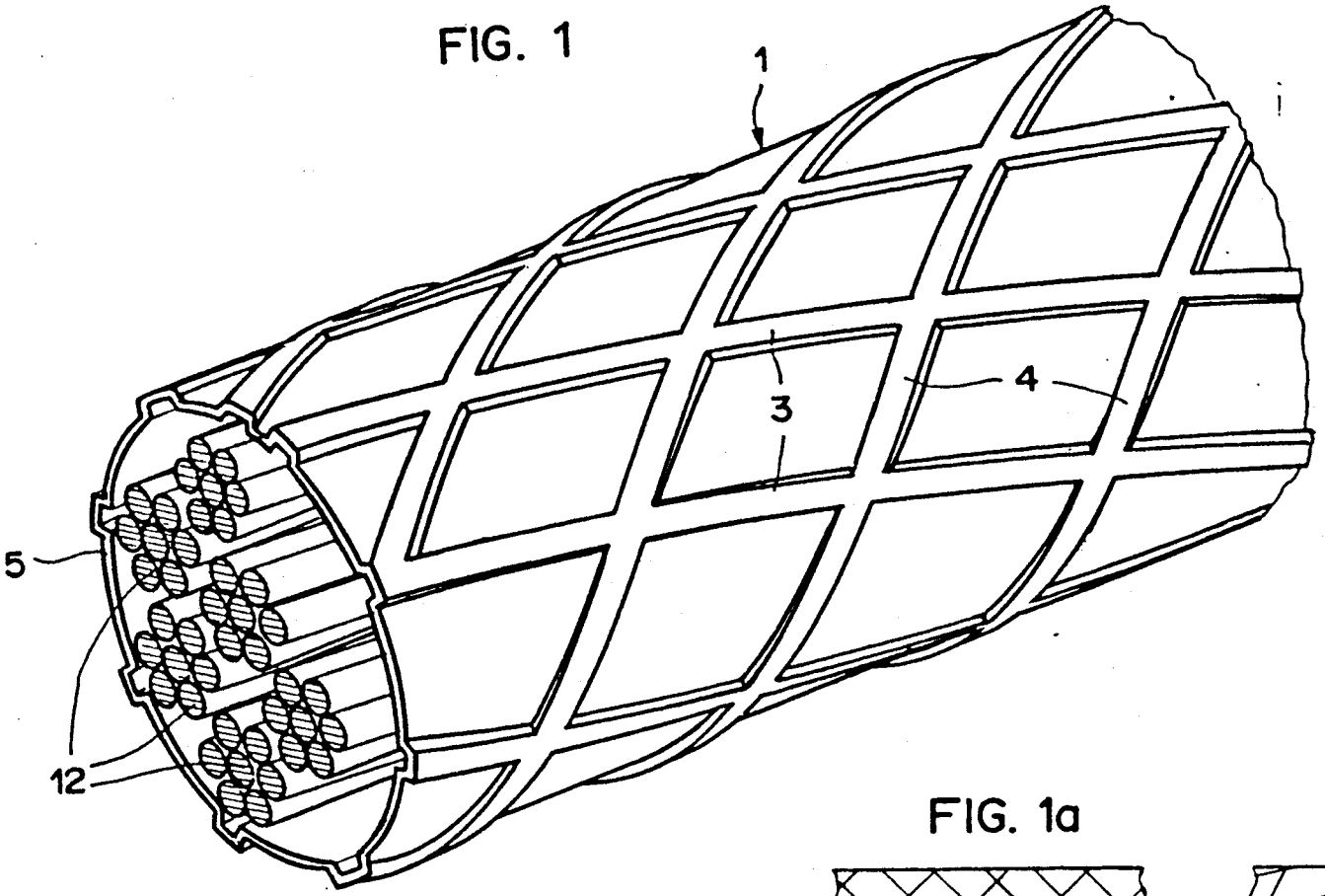

This invention relates to prestressed concrete construction, and more particularly to an encasing tube of synthetic material for enclosing tensioning cable, of the type having a substantially circular cross-section.

Encasing tubing must perform several important functions in the fabrication of supporting structures in the field of tensioning cable technology: (a) keeping a duct open in order to allow the tensioning cable to move longitudinally and thus enable the stretching operation to be carried out; (b) ensuring bonding between the cable and the structure; and (c) ensuring reliable protection against corrosion during the life of the structure.

In order to achieve a certain bonding relationship between the tensioning cable and the encasing tube, as well as between the encasing tube and the supporting structure, tubing with walls having salients or protrusions is used. The areas with the protrusions represent the so-called bonding zones.

Encasing tubes always exhibit a certain amount of contortion after having been laid. Hence it is virtually unavoidable that the tensioning cable comes in contact with the inside wall of the tube, especially after stretching. These points of contact are those locations at which the inside surface of the tubing has no bulges. At the points of contact, lateral pressure are produced between the cable and the wall of the tube when the cable is stretched. Through the normal stress on a supporting structure, friction occurs between the tensioning cable and the encasing tube at such points of contact, and this can lead to wear and tear and finally to destruction of the tensioning cable and/or the encasing tube. In the latter case, friction fatigue and fatigue strength are said to be involved. The fatigue strength of tensioning cable is, on the one hand, decisively influenced by the tubing material. The use of encasing tubes made of plastic rather than steel leads to a substantial improvement in the fatigue strength. On the other hand, in order to achieve high fatigue strength, care must be taken that the lateral pressure between the tensioning cable and the encasing tube is kept as low as possible. This can be achieved by limiting the contortion of the tube and/or by means of an expedient shape of the tube wall in that care is taken to keep the aforementioned contact points, hereafter called friction zones, as large as possible. However, with the encasing tubing currently used, enlarging the friction zones and thereby increasing the fatigue strength inevitably leads to a reduction of the bonding zones and the bonding properties.

After stretching of the cable, the encasing tubes are filled up with an injection material, e.g., with grout. The purpose of the injection material is, for one thing, to establish the bond between the tensioning cable and the encasing tube and, for another thing, to protect the cable from corrosion by enclosing it tightly. For avoiding air bubbles, the flow properties of the injection material are very important. The flow properties are largely determined by the shape and the orientation of the protrusions in the wall of the encasing tube. With the substantially radially disposed protrusions used heretofore, turbulence encouraging the formation of air pockets occurs during injection. A profusion of air pockets, above all such as extend longitudinally, impair the bonding properties, as well as the corrosion protection of the tensioning cable.

It is an object of this invention to provide improved encasing tubing which, through the shape and arrangement of protrusions in the wall, enhances the bonding properties of tensioning cable as compared with prior art encasing tubes, while maintaining the required high fatigue strength in that the bonding zones are enlarged and air pockets are decreased during injection.

To this end, in one form of the encasing tubing according to the present invention, of the type initially mentioned, the improvement comprises a wall having at least two helically running, outwardly directed protrusions, the first protrusion running in the opposite direction from the second protrusion. In another form, the improvement comprises a wall having at least two outwardly directed protrusions running helically in the same direction at different pitches.

Figure 1A:
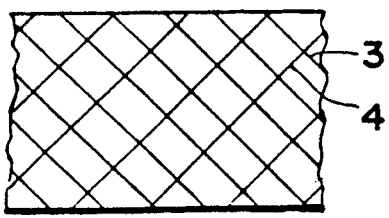
Figure 1B:
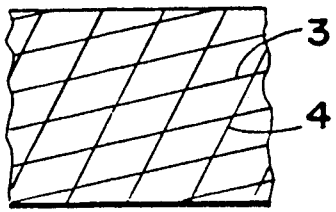
Figure 2:
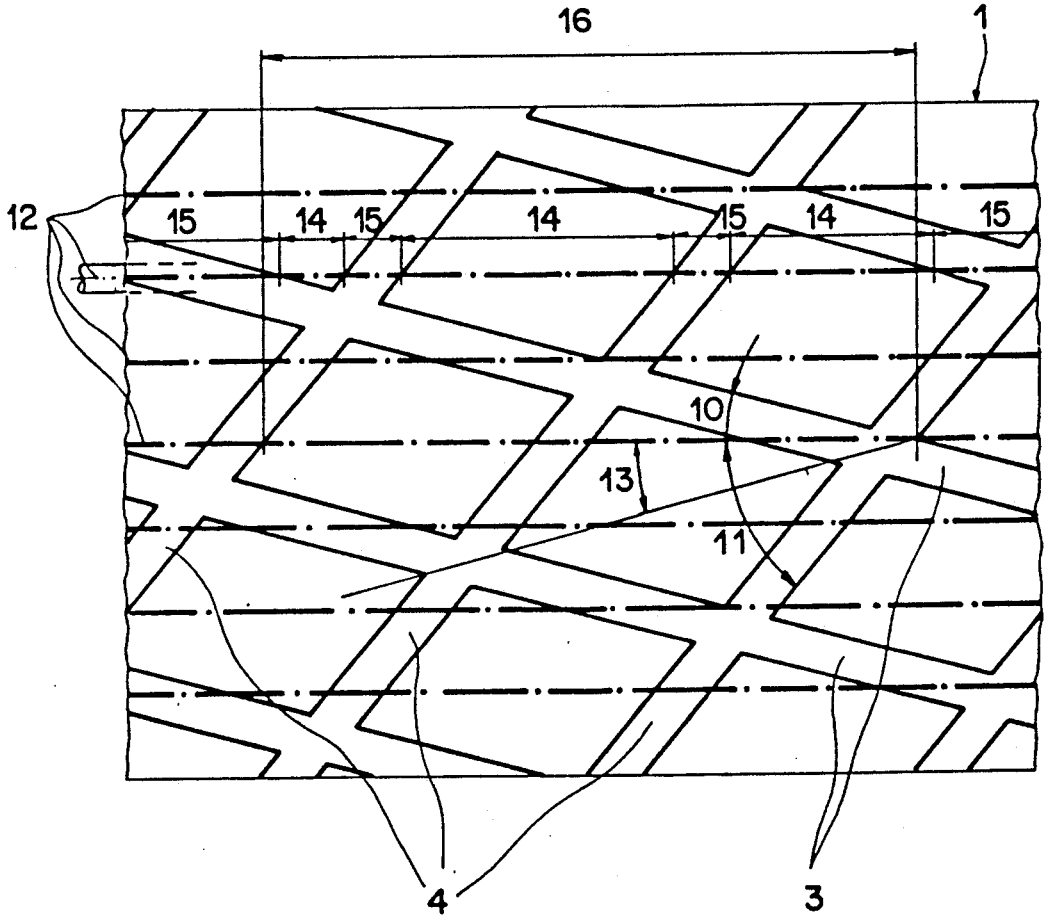
Figure 3:
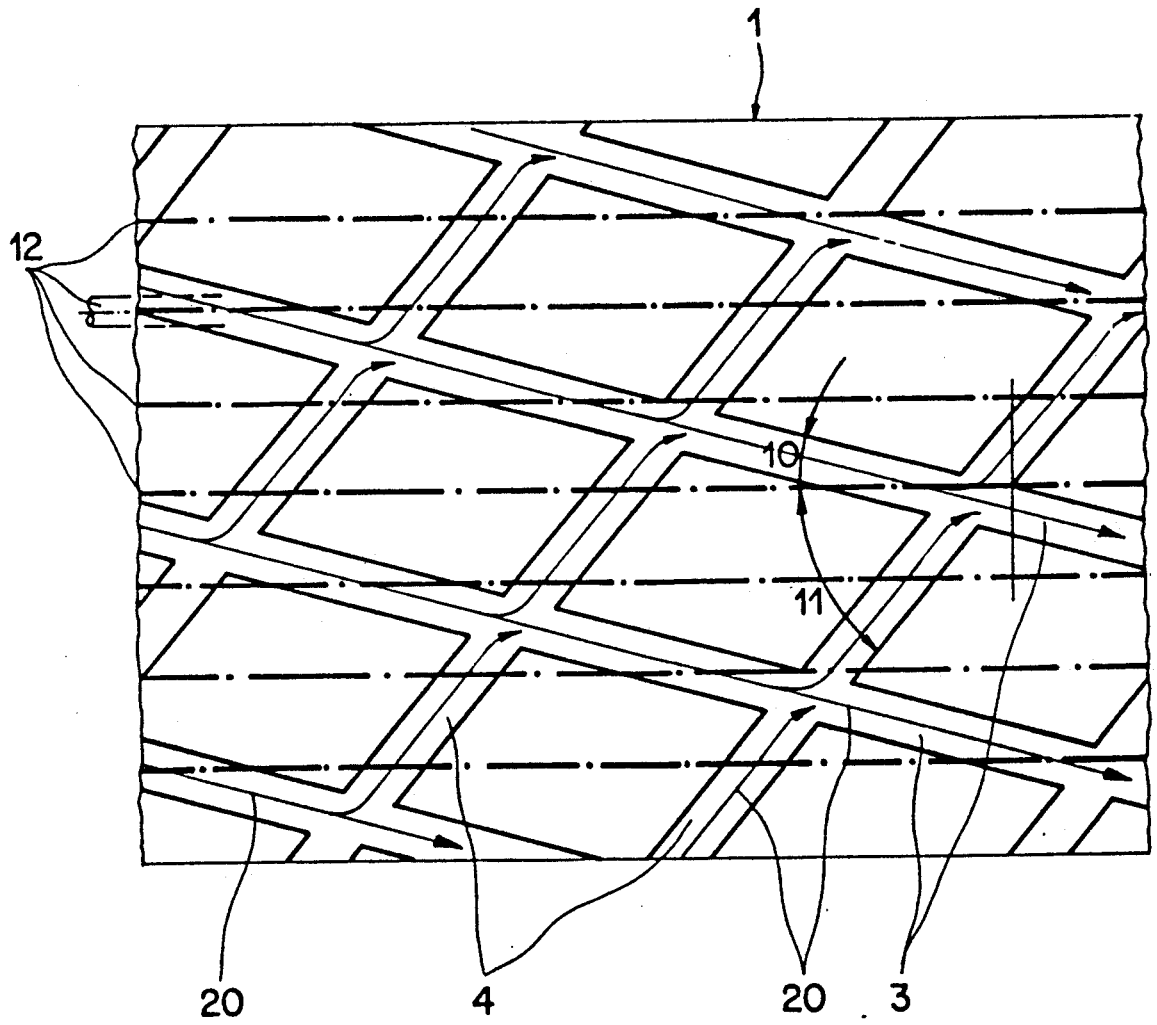
Figure 4:
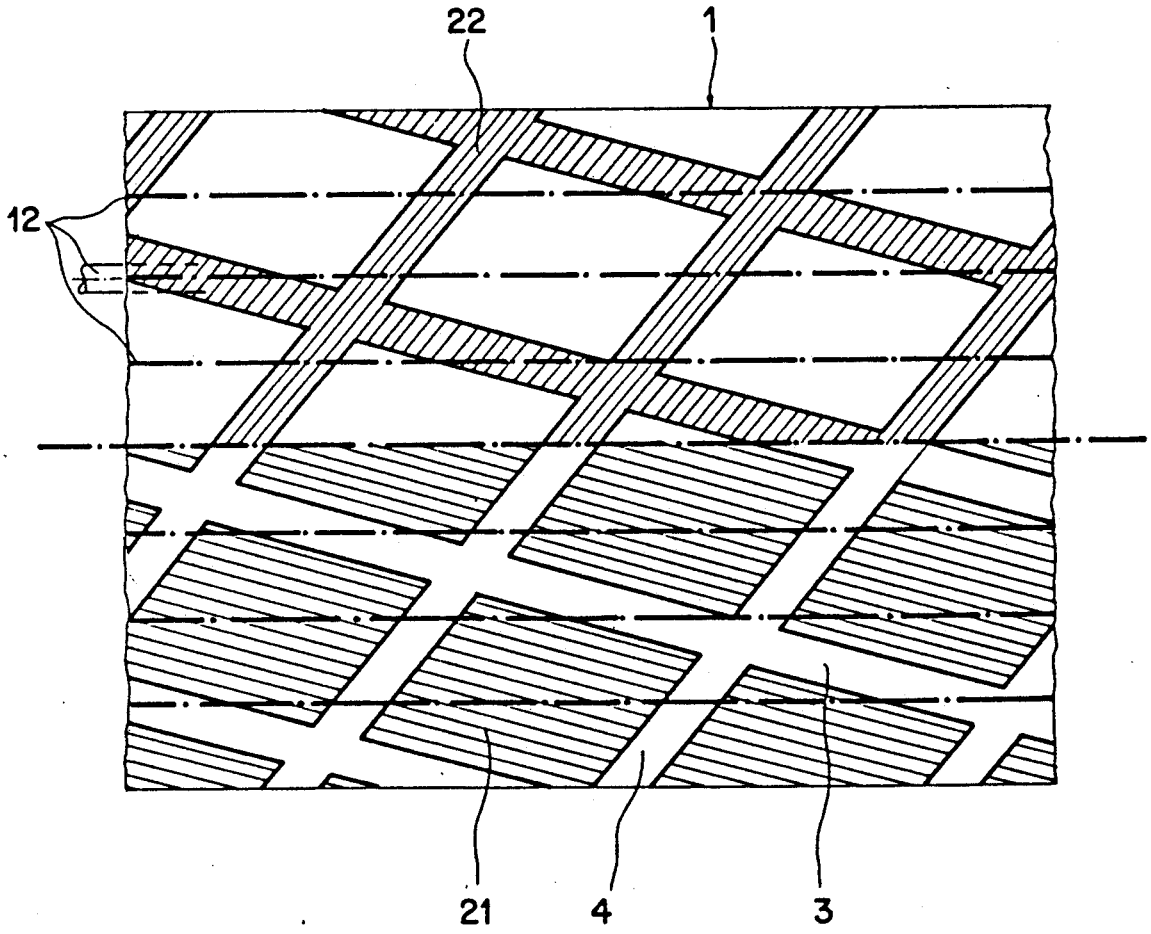

A preferred embodiment of the invention will now be described in detail with reference to the accompanying drawings, in which:

FIG. 1 is a perspective view of a section of the inventive encasing tube,

FIG. 1*a* is a diagrammatic view of the encasing tube with protrusions of identical pitch running in opposite directions, FIG. 1*b* is a diagrammatic view of the encasing tube with protrusions of different pitch running in the same direction, FIG. 2 is a developed view of a section of the encasing tube according to FIG. 1, FIG. 3 is a developed view according to FIG. 2 indicating the flow properties of the injection material within the tube with protrusions disposed according to the invention, and FIG. 4 is a developed view according to FIG. 2 with a diagram of the outer and inner bonding zones.

FIG. 1 shows a section of an encasing tube 1 having a tensioning cable 2 inserted therein. Cable 2 is made up of a plurality of individual strands or parallel wires 12. The wall 5 of tube 1 includes outwardly directed protrusions 3, 4 spiralling over the entire length of the encasing tube. In the exemplified embodiment shown, first protrusions 3 run in the opposite direction from the second protrusions 4. The pitches of the first protrusions 3 are smaller than the pitches of the second protrusions 4. Other modifications in the arrangement of the protrusions 3, 4, such as the same pitch for the first and second protrusions or a spiralling arrangement of the first and second protrusions running in the same direction but at different pitches, are illustrated in FIGS. 1*a* and 1*b* and are quite possible in accordance with the inventive concept. Protrusions 3, 4 of wall 5 have a trapezoidal cross-section. Other shapes, such as triangular, rectangular, arcuate, or sinusoidal, may also be used. Encasing tube 1 is made of plastic, preferably polyethylene. The thickness of wall 5 is 1–7 mm, preferably 2–5 mm.

FIGS. 2, 3, and 4 are developed views of encasing tube 1, with the aid of which the advantageous features of the invention will be described. Spiral protrusions 3, 4 running in wall 5 of tube 1 lead in the developed views of FIGS. 2, 3, and 4 to protrusions shown as running in a straight line at certain pitch angles 10, 11 relative to the axis of tube 1. Angle 10 of the first protrusions 3 is about 15° in the embodiment illustrated. Angle 11 of the second protrusions 4 running in the opposite direction is about 50°. Tests have shown that the pitch angles of the different protrusions 3, 4 should preferably be between 5° and 80°. For the second protrusions 4, the pitch 16 is shown in FIG. 2. The pitch of the first protrusions 3 is substantially greater and is consequently not shown in the drawing. Generally speaking, the pitch of a spiralling protrusion is inversely proportional to the tangent of its pitch angle. The points at which the individual protrusions intersect—running in the same or opposite directions at different pitches—are situated in the developed views on a line forming an angle of twist 13 with the axis of the cable. The individual strands 12 of tensioning cable 2 disposed in encasing tube 1 are each indicated diagrammatically by a dot-dash line in FIGS. 2, 3, and 4. Only one strand 12 is drawn with a broken-line contour. If the sections running along the aforementioned broken-line strand 12 beneath a protrusion 3, 4 are designated as bonding zone 15, and all other sections which are not situated beneath a protrusion 3, 4 as friction zone 14, the result is, for each of the strands 12 indicated, a proportion of friction zones to bonding zones in a ratio of approximately 2:1 for the embodiment illustrated. By modifying the pitch angles 10, 11 of protrusions 3, 4, encasing tubing can be produced having a ratio of frictions zones to bonding zones which is optimized for specific applications. Through the twisting of protrusions 3, 4 with inclusion of the mentioned angle of twist 13, there are continually alternating friction and bonding zones for each of the strands resting against the inside of wall 5 of encasing tube 1. The bond behavior changes continuously but keeps a closed pattern within the bond zone.

FIG. 3 shows the flow properties of a diagrammatically represented injection material 20 upon injection of encasing tube 1. The smaller the pitch angle 10, 11 of one of the two spiralling protrusions 3, 4 relative to the tube axis, the better the flow properties of injection material 20 during injection. Since protrusions 3, 4 are not disposed substantially radially as in prior art encasing tubes, injection clearly takes place more fluidly, with less braking effect and formation of turbulence. Air pockets are virtually eliminated. The second protrusions 4 disposed at a greater pitch angle 11 in the embodiment illustrated serve as a transverse connection to the first protrusions 3 disposed elongatedly at a smaller pitch angle 10. Fluid grout is pressed laterally into the second protrusions 4 and taken in again by the next first protrusion 3 through a suction effect.

In the diagram of FIG. 4, the outer bonding zones 21 of the bond between encasing tube 1 and the surrounding concrete are shown in the lower half of the drawing, while the inner bonding zones 22 of the bond between tube 1 and strands 12 of tensioning cable 2 are shown in the upper half of the drawing. Contrary to prior art encasing tubes having substantially radially disposed protrusions, the bonding proportion of the individual strands 12 of a tensioning cable 2 is greater in the case of the inventive encasing tube 1. The frictional forces produced by normal stress on the supporting structure are uniformly transmitted to the individual strands. Contrary to the inner bonding zones 22 between tube 1 and cable 2, the outer bonding zones 21 between tube 1 and the concrete surrounding the encasing tube are rhomboid.

By means of the spiral arrangement of protrusions 3, 4 running in opposite directions, or of protrusions running in the same direction at different pitches, the bonding zones are substantially enlarged as compared with prior art designs of encasing tubes.

It is also possible, for example, to reduce the height of the protrusions, which further improves the flow properties of the injection material and likewise leads to sufficient bonding properties.

What is claimed is:

1. In an encasing tube of synthetic plastic material capable of supporting and enclosing tensioning cable, of the type having a substantially circular cross-section, the improvement comprising a wall having protrusion means to enhance the bonding properties of the tensioning cable to the encasing tube while decreasing air pockets during injection of grout and maintaining high fatigue strength, said protrusion means constituted by at least a first and a second outwardly extending continuously running spirial protrusion, said first and second protrusions intersecting each other, each of the protrusions on the outside of the wall forming continuously running bulges and on the inside of the wall continuously running open grooves lying in a same cylinder jacket surface to accept the injection mass of grout, the cross-section of the grooves being essentially similar to the cross-section of the bulges, wherein the thickness of said wall is from about 1 mm to about 7 mm.

2. The encasing tube of claim 1, wherein said first protrusion runs in the opposite direction from said second protrusion, and wherein said first and second protrusions are of equal pitch.

3. The encasing tube of claim 1, wherein said first protrusion runs in the opposite direction from second protrusion, and wherein said first and second protrusion are of differing pitches.

4. The encasing tube of claim 1, wherein each said protrusion has a triangular, rectangular, trapezoidal, arcuate, or sinusoidal cross section as defined by the line of intersection between said protrusion and a cross-sectional plane and an imaginary line following the generally circular inner contour of the tube.

5. The encasing tube of claim 1, wherein the pitch angle of each said spiral protrusion in relation to the encasing tube axis is from about 5° to about 80°.

6. The encasing tube of claim 1, wherein the thickness of said wall is from about 2 to about 5 mm.

7. The encasing tube of claim 1, wherein said tube is made of polyethylene.

8. The encasing tube of claim 1, wherein said tube is devoid of external reinforcement.

9. The encasing tube of claim 1, wherein each said protrusion has a trapezoidal cross section as defined by the line of intersection between said protrusion and a cross-sectional plane and an imaginary line following the generally circular inner contour of the tube.

10. The encasing tube of claim 1, wherein said first protrusion and said second protrusion run in the same direction at different pitches.

* * * * *